US005365983A

United States Patent [19]

Oertli

[11] Patent Number: 5,365,983

[45] Date of Patent: Nov. 22, 1994

[54] METHOD AND DEVICE FOR HOUSING NON-SHEDDING LOOM SHAFT RODS

[75] Inventor: Gustav Oertli, Brütten, Switzerland

[73] Assignee: Sulzer Rueti AG, Rueti, Switzerland

[21] Appl. No.: 118,059

[22] Filed: Sep. 7, 1993

[30] Foreign Application Priority Data

Nov. 13, 1992 [EP] European Pat. Off. ..... 92810885.1

[51] Int. Cl.[5] ..... D03C 1/14

[52] U.S. Cl. ..... 139/57; 139/82; 24/563

[58] Field of Search ..... 139/82, 57; 24/67.9, 24/563, 543, 339; 70/198, 199; 40/11, 13; 211/89

[56] References Cited

U.S. PATENT DOCUMENTS

| | | | |
|---|---|---|---|
| 2,231,462 | 12/1938 | Cobb | 24/339 X |
| 2,526,766 | 10/1950 | Ornell | 211/89 |
| 3,387,343 | 6/1968 | Fitz-Gerald | 24/339 X |
| 3,391,432 | 7/1968 | Rocher | 24/339 X |
| 3,888,284 | 6/1975 | Tiernan . | |
| 3,946,877 | 3/1976 | Galicia | 211/89 X |
| 4,775,121 | 10/1988 | Carty | 24/543 X |
| 4,940,143 | 7/1990 | Stanfield | 24/563 X |

FOREIGN PATENT DOCUMENTS

| | | | |
|---|---|---|---|
| 1249597 | 8/1967 | Germany | 24/339 |
| 373083 | 12/1963 | Switzerland | 24/339 |

*Primary Examiner*—Andrew M. Falik
*Attorney, Agent, or Firm*—Townsend and Townsend Khourie and Crew

[57] ABSTRACT

A device comprises a member having a number of recesses open on one side, into which the shaft rods of a loom can be inserted and movably retained. The device also includes a mechanism which prevents an unintentional removal of the shaft rods. The positional relationship of the device with respect to the shaft drive in a loom ensures that the shaft rods not required perform a lifting movement during the operation of the loom.

12 Claims, 1 Drawing Sheet

METHOD AND DEVICE FOR HOUSING NON-SHEDDING LOOM SHAFT RODS

BACKGROUND OF THE INVENTION

The present invention relates to a device for housing shaft rods which are not required for shedding.

As is known, shaft rods not used during shedding are swivelled to the side, whereby the shaft rods either loosely abut the frame or are exclusively held by the toggle lever of the shaft drive.

This produces the disadvantages of the shaft rods being out of action beneath the heald shaft or respectively being moved up and down by the toggle lever, but there is no relative movement between the shaft rod and toggle lever. One of the results of this is that static damage is unavoidable in the articulation between the shaft rod and the toggle lever.

The object of the present invention is to create a device for housing shaft rods, which retains said shaft rods movably in a defined position.

SUMMARY OF THE INVENTION

This object is achieved in accordance with the invention by providing a member having recesses into which the shaft rods are inserted. The recesses retain the shaft rods movably so that the shaft rod and toggle lever may angularly displace relative to one another thereby avoiding the aforementioned static damage.

The occurrence of static damage can be avoided with this arrangement.

The invention is explained below by means of the attached drawings.

DESCRIPTION OF THE PREFERRED EMBODIMENTS

With the device under discussion here, the shaft rods not required for shedding are retained in a defined position.

Figure 1:
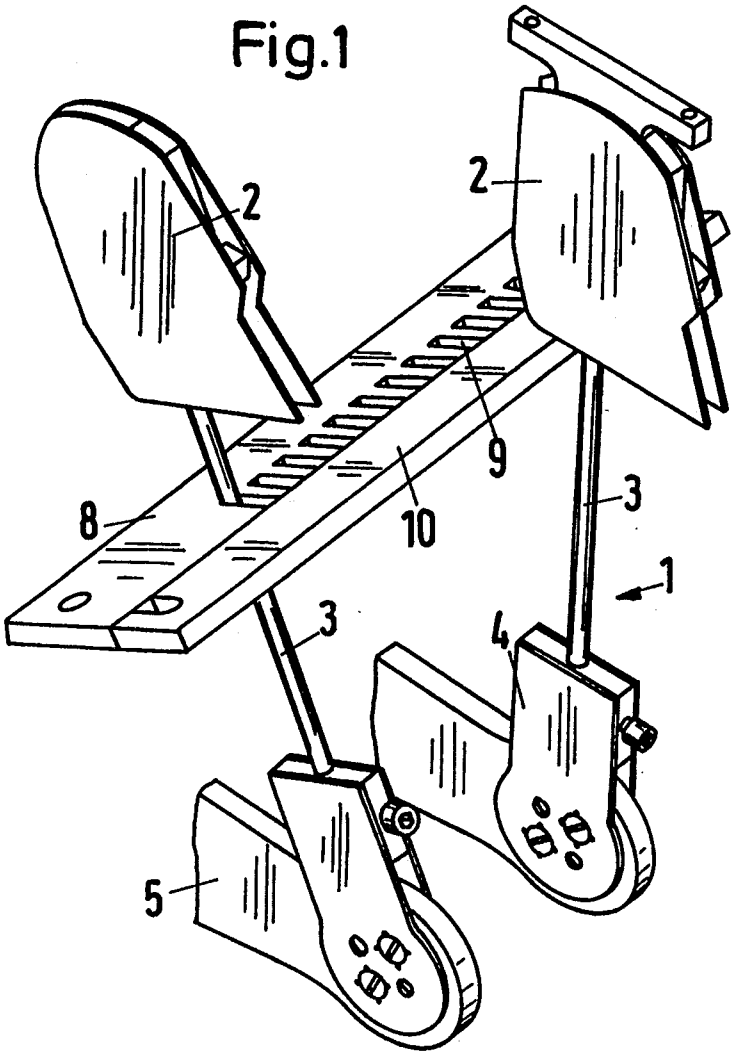
FIG. 1 shows a three-dimensional view of a first embodiment a device according to the invention.
Figure 2:
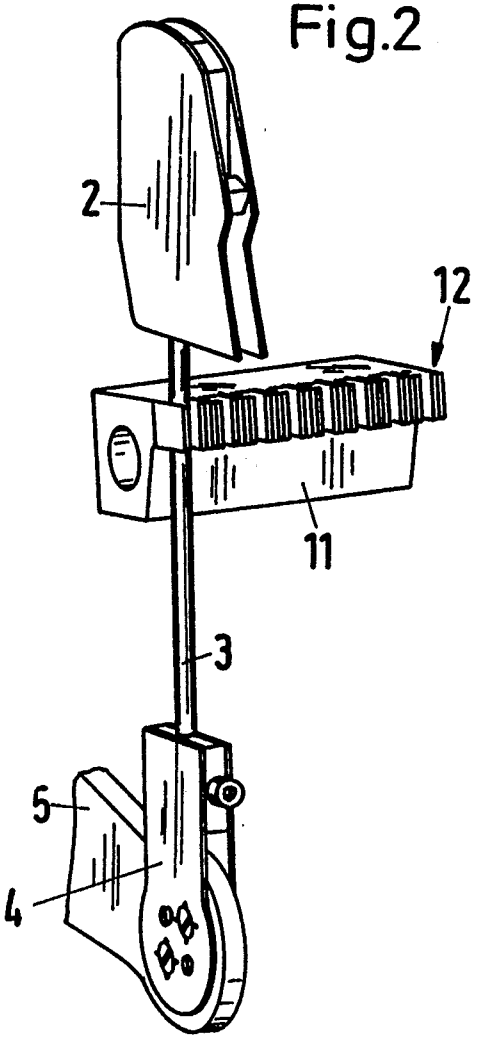
FIG. 2 shows a three-dimensional view of a second embodiment of a device according to the invention and FIG. 3 shows a plan view of a part of the device shown in FIG. 2.

FIG. 1 shows a non-operational shaft rod and a shaft rod ready for operation, and FIG. 2 shows just a non-operational shaft rod. Shaft rod 1 contains a coupling part 2 of a shaft coupling, a rod 3, to which firstly the coupling part 2 and secondly an articulation 4 are attached. A screw connection is advantageously chosen to attach the coupling part 2 and the articulation 4. The shaft rod 1 is connected in a rotationally mobile manner via articulation 4 to a toggle lever 5, which is part of a shaft drive (not shown). In the embodiment shown in FIG. 1, the device contains an oblong member 8, which on one longitudinal side is provided with a number of slots 9, which are disposed horizontally in a row with constant spacing, and a closing strip 10, which is detachably mounted on the member 8 and closes the slots 9 in order to retain the shaft rods 1.

Figure 3:
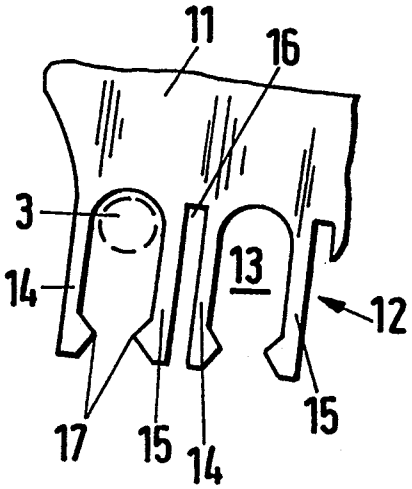

In the embodiment shown in FIG. 2 and 3, the device consists of an oblong member 11, which on one longitudinal side comprises a part 12 having a number of recesses 13. In the embodiment shown, part 12 is constructed in one piece with member 11. It is pointed out that part 12 can be constructed as a separate part and can be attached to member 11 with suitable means.

The recess 13 is limited by two freely protruding arms 14, 15, which are elastic. To enable the deflection of the arms 14, 15, a slit 16 is provided between the wall parts 15, 14 limiting the adjacent recesses 13. At its free end each arm 14, 15 comprises a swelling 17, which is directed towards the recess 13 and extends over the width of the arm 14, 15. The swellings 17 form an aperture width which is smaller than the rod cross-section, so that the rod 3 (shown by dot-dash lines) can not be unintentionally removed from the recess 13.

Although the embodiment shown in FIG. 1 is intended for a manual removal of the shaft rods, the embodiment shown in FIG. 2 and 3 is suitable for the automatic supply and removal of the shaft rods during the shedding motion.

I claim:

1. In a loom a device for housing a shaft rod not required for shedding comprising:

a member including a plurality of recesses having an open side, the open side being adapted to receive the shaft rod, the plurality of recesses having means for permitting movement of the shaft rod within the recess.

2. A device according to claim 1, wherein:

the plurality of recesses are aligned parallel to one another and disposed horizontally in a row with a constant spacing.

3. A device according to claim 1, wherein:

the movement permitting means comprises a a slot-shaped construction for the plurality of recesses, the slot-shaped construction having a recess width and a recess length, the recess length being larger than the recess width so that said shaft rod can move within said recess.

4. A device according to claim 1, wherein:

the plurality of recesses are limited on two sides by an elastic arm.

5. A device according to claim 4, wherein:

each elastic arm comprises a swelling directed towards the recess.

6. A device according to claim 1, wherein:

the member comprises plastic.

7. A device according to claim 1, further comprising:

a closing member which closes the open side of the plurality of recesses.

8. A loom having a device for housing shaft rods of a loom not required for shedding comprising:

a shaft;

shaft rods adapted to be coupled to the shaft and being connected to a shaft drive; and a member including a plurality of recesses having an open side, the open side being adapted to receive a shaft rod, the plurality of recesses having means for permitting movement of the shaft rod within each recess, the member being disposed beneath the shaft and outside the range of movement of active shaft rods and coupling parts so that the shaft rods not required for shedding can be moved by the shaft drive.

9. A device according to claim 8, wherein:

the movement permitting means comprises a slot-shaped construction for the plurality of recesses, the plurality of recesses having a recess width and a recess length the recess length being larger than the recess width so that the shaft rod can move within said recess.

10. A loom according to claim 8, wherein:

the member further comprises a slit between adjacent recesses in the plurality of recesses.

11. A device according to claim 1, wherein:

the member further comprises a slit between adjacent recesses in the plurality of recesses.

12. A method for housing a shaft rod not required for shedding, comprising the steps of:

rotatably coupling a shaft rod to a toggle lever at an articulation and drivingly coupling the toggle lever to a shaft drive;

positioning the shaft rod into a recess of a member when the shaft rod is not required for shedding; and articulating a joint between the shaft rod and the toggle lever while the shaft rod is positioned in the recess thereby preventing static damage to the articulation.

* * * * *